US006181772B1

(12) United States Patent
Reina et al.

(10) Patent No.: US 6,181,772 B1
(45) Date of Patent: Jan. 30, 2001

(54) OPEN CORNERED GRID STRUCTURE AND METHOD OF MAKING

(76) Inventors: Leo J. Reina, 7913 Hickory Nut Grove Rd.; James T. Sorgani, 33 Carol La., both of Cary, IL (US) 60013

( * ) Notice: Under 35 U.S.C. 154(b), the term of this patent shall be extended for 0 days.

(21) Appl. No.: 09/283,783

(22) Filed: Apr. 1, 1999

(51) Int. Cl.[7] ..... G21K 1/10
(52) U.S. Cl. ..... 378/154; 378/155
(58) Field of Search ..... 378/154, 155, 378/169, 172, 182

(56) References Cited

U.S. PATENT DOCUMENTS

| | | | | |
|---|---|---|---|---|
| 2,989,634 | | 6/1961 | Ould et al. . | |
| 3,370,822 | | 2/1968 | Miller . | |
| 3,964,107 | | 6/1976 | Stievenart et al. . | |
| 3,973,127 | | 8/1976 | Matsuda et al. . | |
| 4,310,766 | * | 1/1982 | Finkenzeller et al. | 378/155 |
| 4,542,523 | | 9/1985 | Erikson . | |
| 4,706,269 | | 11/1987 | Reina et al. . | |
| 4,760,589 | * | 7/1988 | Siczek | 378/155 |
| 4,809,313 | | 2/1989 | Gandolfo . | |
| 4,937,849 | | 6/1990 | Hubert et al. . | |
| 5,008,920 | | 4/1991 | Gralak . | |
| 5,310,059 | | 5/1994 | Robertson . | |
| 5,357,553 | | 10/1994 | Ferlic et al. . | |
| 5,809,107 | | 9/1998 | Schmitt . | |
| 6,064,720 | * | 7/2000 | Piscitelly et al. | 378/154 |

* cited by examiner

*Primary Examiner*—David P. Porta
*Assistant Examiner*—Irakli Kiknadze
(74) *Attorney, Agent, or Firm*—Mathew R. P. Perrone, Jr.

(57) ABSTRACT

A grid enclosure for an X-ray cassette has a rugged construction, and is easy to us efficient in operation, with open corners therein to achieve the desired protection of an X-ray cassette.

21 Claims, 3 Drawing Sheets

OPEN CORNERED GRID STRUCTURE AND METHOD OF MAKING

This invention relates to an X-ray grid structure; and more specifically to an X-ray grid structure having open corners to simplify manufacturing of the grid and insertion of the contents therein.

BACKGROUND OF THE INVENTION

It is well known to those persons who are acquainted with the particular field of medicine relating to an X-ray, that examination products of this type, namely an anti-scatter grid structure, currently on the market serve only to accommodate an X-ray cassette, but they do little or nothing for protection of the X-ray grid or cassette.

In fact, each anti-scatter grid structure wears out or usually falls apart within two years from normal use. A single X-ray grid may cost as much as fifteen hundred dollars. A damaged or worn out grid can produce unsatisfactory X-rays. It is, thus, necessary to avoid or minimize damage to an X-ray grid, in order to minimize costs and maximize efficiency.

A damaged grid can produce a distorted X-ray, that can misinterpreted because of the lead lines that run vertical through the grid. When the lead lines are displaced due to damage to the X-ray grid, they cause radiographic artifacts. The displaced lead lines superimpose the anatomical views that have been radiographed. If such a line is imposed over a rib or in the skull, it may be interpreted as a fracture.

In many cases such misinterpretations are both possible and mandatory, due to the resulting X-ray. With structural defects of this type, radiologists are sued because the X-ray films are confusing. As result of the confusion, a radiologist can misinterpret the X-ray because of the damaged grid; and can either misdiagnose an injury or diagnose an injury, which the patient has not suffered.

A very suitable anti-scatter grid structure is thoroughly described in the U.S. Pat. No. 4,706,269 to Leo J. Reina el al., said patent being incorporated herein and made a part hereof by reference. The said Leo J. Reina is the inventor in this application.

A very complicated procedure is used to produce the anti-scatter grid. The material used and the assembly procedure add to these complications. Simplification of such an assembly can provide a great advantage to medical field.

SUMMARY OF THE INVENTION

Among the many objectives of this invention is the provision of an anti-scatter grid structure with a open corners.

Another objective of this invention is to provide a anti-scatter grid structure, which protects the X-ray grid.

Yet another objective of this invention is to provide a anti-scatter grid structure with open corners, which protects the X-ray cassette.

Still another objective of this invention is to provide an anti-scatter grid structure, having one material in the manufacturing thereof.

Also an object of this present invention is to provide a protective encasement for an X-ray which gives a total protection thereto so as to extend the useful life of the grid as long as possible.

A further object is to provide a grid enclosure, which virtually eliminates the need for X-ray grid replacements due to accidental droppage.

These and other objectives of the invention (which other objectives become clear by consideration of the specification, claims and drawings as a whole) are met by providing a one piece or a two piece grid structure, which is simple in design, inexpensive to manufacture, rugged in construction, easy to use, and efficient in operation, with open corners therein to achieve the desired protection for the X-ray cassette.

BRIEF DESCRIPTION OF THE DRAWINGS

Throughout the figures of the drawings where the same part appears in more than one figure the same number is applied thereto.

DESCRIPTION OF THE PREFERRED EMBODIMENTS

Figure 1:
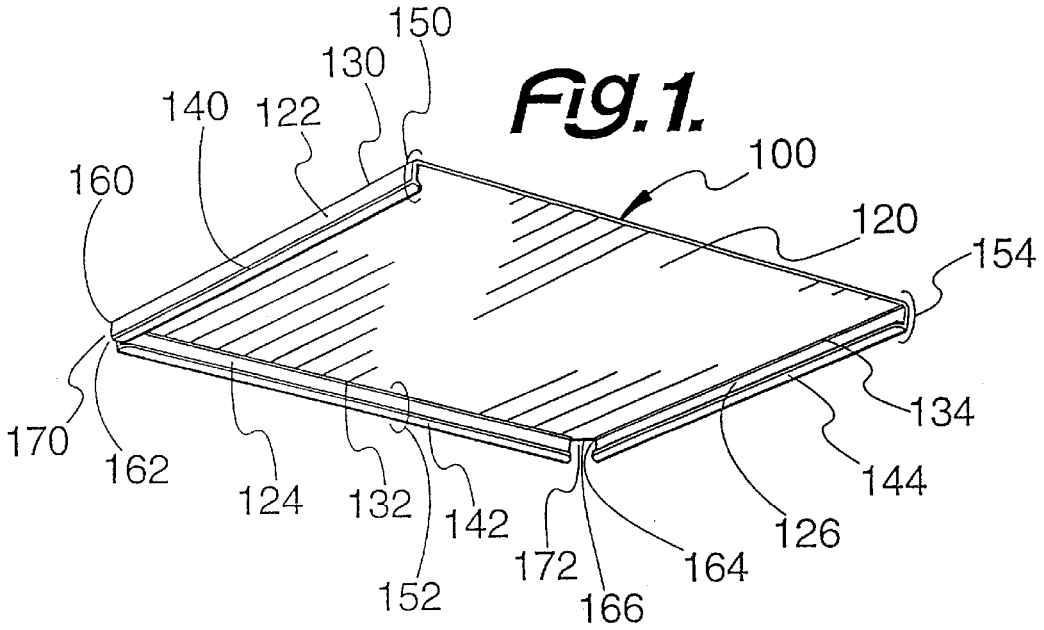
FIG. 1 depicts a perspective view of one piece X-ray grid structure 100 and with dotted lines showing the way in which a cassette 110 can be assembled to form a two piece anti-scatter grid cassette.

This invention relates to a new method of manufacturing an X-ray grid structure. The present invention additionally relates to a new and improved X-ray grid structure for assembly with a cassette, with the X-ray grid structure having a simplified structure and cost of manufacture. The grid structure may be a one-piece grid structure or a two-piece grid structure.

One-piece Grid Structure

A first embodiment is a one-piece, protective anti-scatter grid structure for protectively housing an X-ray cassette therein includes a flat top panel having a size adapted to support an X-ray cassette. From the flat top panel having a generally rectangular shape, the grid structure may be formed.

An upper ledge is formed as part of the top panel. A lower ledge is vertically spaced therefrom and sized for under lapping and supporting a cassette therein. A side bar or elongated member connects the lower ledge or bottom edge to the top panel. There are three side bars, one on each of three sides of the anti-static grid structure.

The anti-scatter grid structure is thoroughly described in the U.S. Pat. No. 4,706,269 to Leo J. Reina et al., the said Leo J. Reina being the inventor in this application. This application provides for the improvement based on the indicated patent in that a one- piece anti-scatter grid structure, with open corners is provided.

By open corners is meant the X-ray grid structure has a portion of each corner removed. The open corners provide for ease of manufacture for the one piece X-ray grid structure, while still providing for good protection of the cassette.

If the grid in the holder is ever damaged, such damage must come be from a massive blow to it, so that it will crush the X-ray grid structure itself. One of the inventive concepts here disclosed embodies the idea that the droppage impact is distributed through the holder and not the grid thereby lengthening the life of the grid compared with the prior art devices.

Two-piece Grid Structure

A second embodiment of this grid for an x-ray cassette is a two piece embodiment. There is a top piece of a generally rectangular shape adapted to receive the cassette. The corners of the top piece are open. That is, there is a forty-five degree angle on each corner. The top piece is solid.

The lower piece has an open large surface and extended open corners. The lower piece is nestable within the upper or top piece and sandwiches the x-ray cassette therebetween. A snapping mechanism on the edge of the corners fits into the open corner of the top piece and removably locks the two pieces together sandwiching the x-ray cassette therebetween. In this fashion, the x-ray cassette can be efficiently assembled.

The open corners for the assembled package provide for protection and ease of assembly. In this fashion, advantages are achieved, for protection and ease of assembly.

The upper member or top piece has flanges at a right angle to the top panel. The four flanges lack a connection with its corresponding perpendicular member in order to provide for the opening in each corner.

The wall portion includes an open top. The open top surface is adapted to permit the x-ray cassette to be used. The open top surface provides for a top ridge perpendicular to each of the four corners. At each of the four corners, may be an extended snap mechanism designed to be received by the open corners of the upper or top piece.

The top ridge is adjacent to the open top. This structure permits cooperation with the top member. The X-ray cassette can then be held therebetween and within the grid assembly, when used in combination with the top cover.

Preferably, a releasable adhesive holds the lower piece in the top piece. If the adhesive wears off, it may easily be replaced. Such adhesive provides easier manufacture than the snap mechanism.

In summary, it is very important that the grid be maintained in a damage free state. These grids require real protection. This new X-ray grid structures and its new method of manufacture provide a vastly improved performance. It also has a far superior useful life over any other device of its kind.

Figure 2:
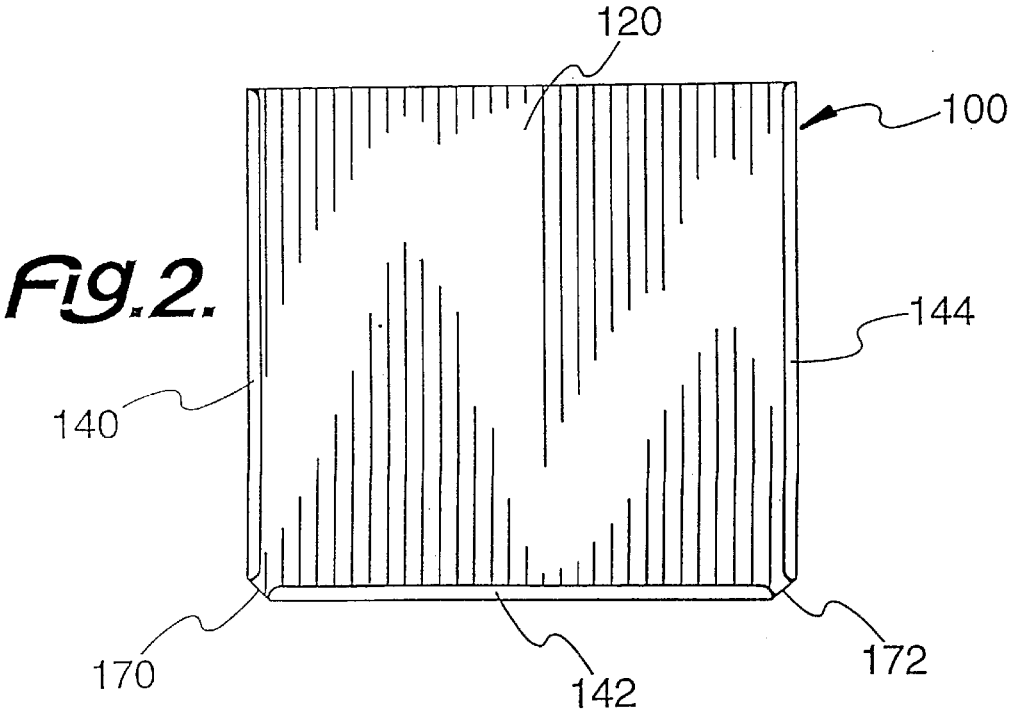
FIG. 2 depicts a bottom plan view of the one piece X-ray grid structure 100 as seen in FIG. 1.
Figure 3:
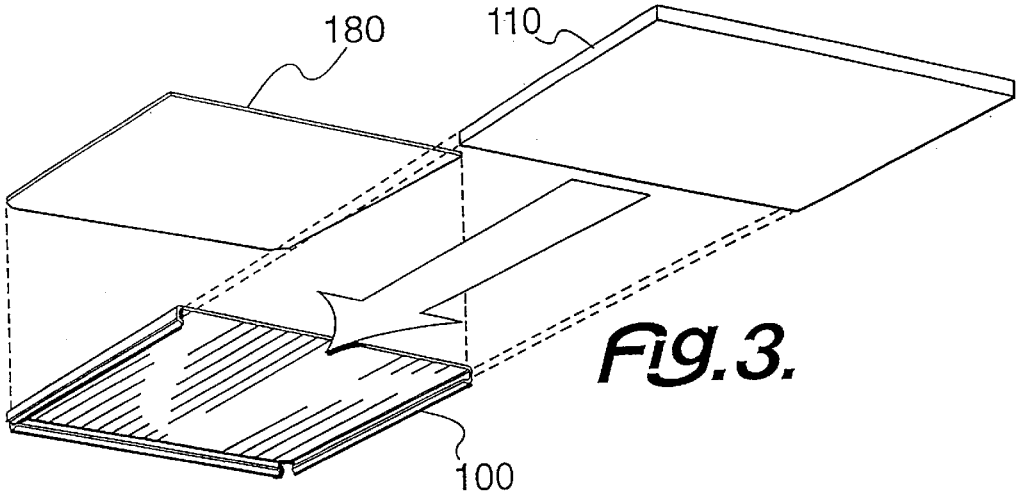
FIG. 3 is an exploded view of the one piece X-ray grid structure 100 as shown in FIG. 1.

Referring now to FIG. 1, FIG. 2 and FIG. 3, a one piece X-ray grid structure 100 embodies important features of this invention. The one piece X-ray grid structure 100 is particularly constructed for assembly with an X-ray cassette 110. The one piece X-ray grid structure 100 includes a top rectangular panel 120. This flat top panel 120 has a first elongated member 122, a second elongated member 124, and a third elongated member 126 each extending from an edge of flat panel 120 to protectively encase the X-ray cassette 110 against impact forces, which may be applied to the panel 120 in a circumstance where the panel 120 might be dropped or given rough handling by an X-ray technician when being removed from storage or placed into storage.

More particularly, first elongated member 122 extends from first panel edge 130 of flat top panel 120. In a like fashion, second elongated member 124 extends from second panel edge 132 of flat top panel 120. Similarly, third elongated member 126 extends from third panel edge 134 of flat panel 120. The one-piece grid structure 100 protectively encases the X-ray cassette 110 against impact forces, which may be applied to the panel 120 in a circumstance where the panel 120 might be dropped or given rough handling by an X-ray technician when being removed from storage or placed into storage.

A first bottom edge 140, a second bottom edge 142 and a third bottom edge 144 provide a squared u-shaped frame around three side edges of the panel 120. First bottom edge 140 extends from first elongated member 122. Second bottom edge 142 extends from second elongated member 124. Third bottom edge 144 extends from third elongated member 126. Thus, a lower ledge is vertically spaced from panel 120 and sized for underlapping and supporting a cassette 110 therein.

First elongated member 122 combines with first bottom edge 140 and top panel 120 to form first U-shaped member 150. Second elongated member 124 combines with second bottom edge 142 and top panel 120 to form second U-shaped member 152. Third elongated member 126 combines with third bottom edge 134 and top panel 120 to form third U-shaped member 154.

First extended corner end 160 of first elongated member 122 is adjacent to first open corner end 162 of second elongated member 124, and define first open corner 170. Third extended corner end 164 of third elongated member 126 is adjacent to second open corner end 166 of second elongated member 124, and define second open corner 172. First open corner 170 and second open corner 172 are formed by removing or eliminating a corner from rectangular portion or top portion 120 or shaping anti-scatter grid structure 100.

Likewise third open corner 174 and fourth open corner 176 are formed by removing or eliminating a corner from rectangular portion or top portion 120 or shaping anti-scatter grid structure 100. Thus, X-ray cassette 110 has all four corners exposed when in either one piece anti-scatter grid structure 100 or two piece anti-scatter grid structure 200.

Figure 4:
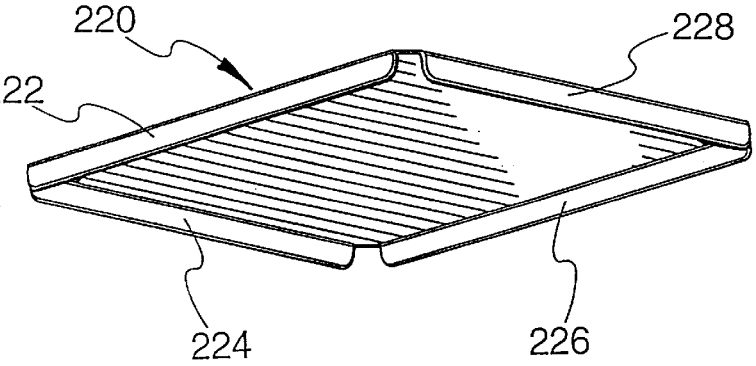
FIG. 4 depicts a perspective view of top solid panel 220 of two piece X-ray grid structure 200.
Figure 5:
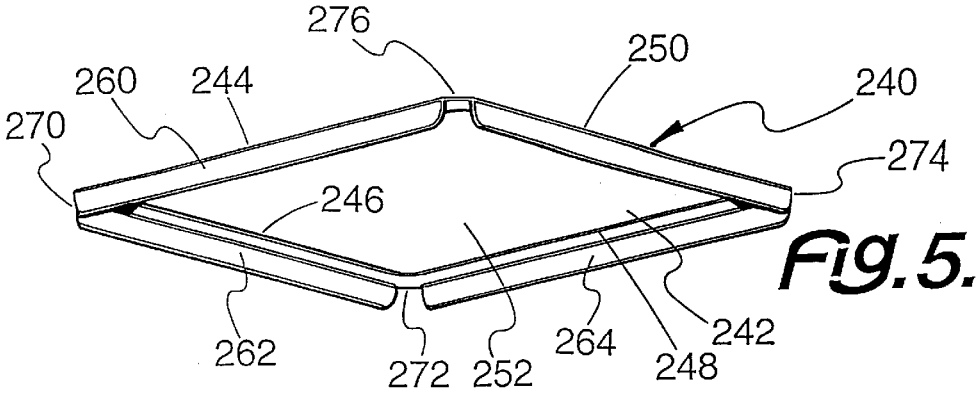
FIG. 5 depicts a bottom plan view of bottom open panel 240 of the two piece X-ray grid structure 200.
Figure 6:
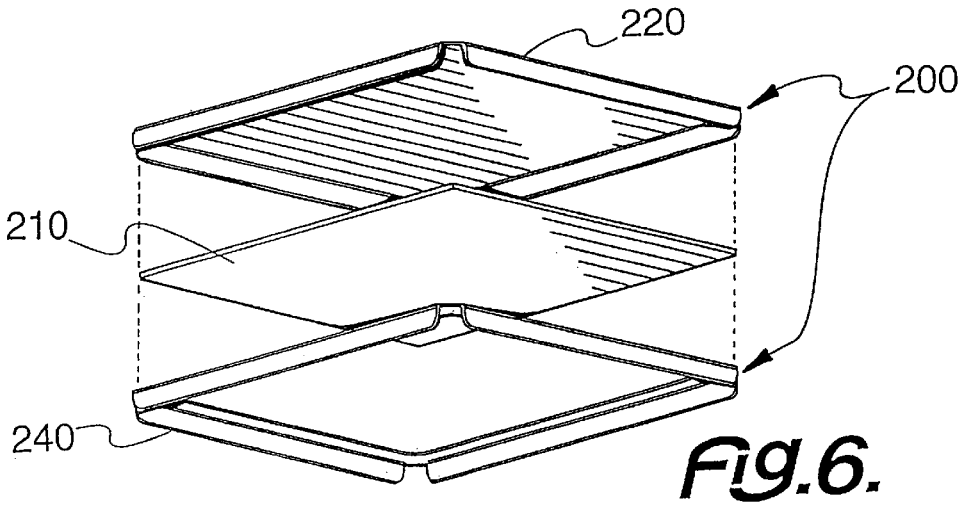
FIG. 6 depicts an exploded view of the two piece X-ray grid structure 200 combining FIG. 4 and FIG. 5 with a cassette 110.

Referring now to FIG. 4, FIG. 5, and FIG. 6, a two piece X-ray grid structure 200 embodies important features of a second embodiment of this invention. The one piece X-ray grid structure 100 is particularly constructed for assembly with an X-ray cassette 110. The two piece X-ray grid structure 200 includes a top solid panel 220 and is also compatible with X-ray cassette 110 and the like.

This top solid panel 220 has a first flange member 222, a second flange member 224, and a third flange member 226 each extending from an edge of top solid panel 220 to protectively encase the X-ray cassette 110 against impact forces, which may be applied to the two-piece grid 220 in a circumstance where the two-piece structure 200 might be dropped or given rough handling by an X-ray technician when being removed from storage or placed into storage.

As an option, vinyl cover 180 may be applied to either top panel 120 of one piece X-ray grid structure 100 or to top solid panel 220 of two piece X-ray grid structure 200. Vinyl cover 180 provides protection for either grid structure. Color coding of the vinyl cover 180 can be used as a filing mechanism too. Vinyl cover 180 is attached by bonding, gluing or either suitable fashion.

More particularly, first flange member 222 extends from first solid edge 230 of top solid panel 220. In a like fashion, second flange member 224 extends from second solid edge 232 of top solid panel 220. Similarly, third flange member 226 extends from third solid edge 234 of top solid panel 220. The two-piece grid structure 200 protectively encases the X-ray cassette 110 against impact forces, which may be applied to the top solid panel 220 in a circumstance of dropping or given rough handling by an X-ray technician when being removed from storage or placed into storage.

Cooperating with top solid panel 220 is bottom open panel 240. Bottom open panel 240 has an open top section 242. Open top section 242 has a first open edge 244, a second open edge 246, a third open edge 248, and a fourth open edge 250, framing opening 252 of open top section 242. Opening 252 cooperates with top solid panel 220 to frame X-ray cassette 110.

First extension 260 extends from first open edge 244. Second extension 262 extends from second open edge 246. Third extension 264 extends from third open edge 248. Fourth extension 266 extends from a fourth open edge 250.

First corner snap 270 is positioned on open top section 242 between first extension 260 and second extension 262. Second corner snap 272 is positioned on open top section 242 between third extension 264 and second extension 262. Third corner snap 274 is positioned on open top section 242 between third extension 264 and fourth extension 266. Fourth corner snap 276 is positioned on open top section 242 between fourth extension 266 and first extension 260.

First corner snap 270 snap fits between first flange member 222 and second flange member 224. Second corner snap 272 snap fits between second flange member 224 and a third flange member 226. Third corner snap 274 snap fits between third flange member 226 and fourth flange member 228. Fourth corner snap 276 snap fits between first flange member 222 and a fourth flange member 228. Of course, releasable adhesive is preferred over the snap arrangement.

X-ray grid 110 appears in opening 250 as x-ray grid structure 100 is positioned between top solid panel 220 and bottom open panel 240 to protectively encase the X-ray cassette 110 against impact forces. An open corner structure results therefrom.

The preferred material used to form the one piece X-ray grid structure 100 or two piece X-ray grid structure 200 is required to have both shatter proof characteristics, as well as impact resistant capability. Such a material is the material of choice because of its desirable qualities.

The preferred material used to form the one piece X-ray grid structure 100 or the two piece X-ray grid structure 200 is bendable aluminum. Sheets of aluminum, which are strong enough to offer protection, but remain bendable provide for the ease of manufacture.

Figure 7:
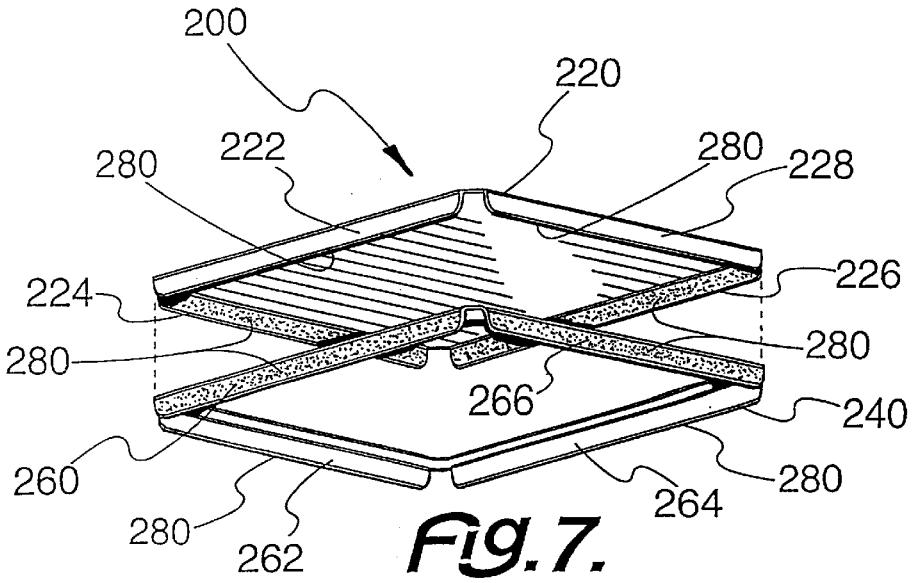
FIG. 7 depicts an exploded view of the two piece X-ray grid structure 200 with adhesive 280 on lapping edges.

In FIG. 7, the two piece X-ray grid structure 200 has a releasable adhesive 280 on lapping edges of top solid panel 220 and bottom open panel 240 when they are assembled into two piece X-ray grid structure 200. The releasable adhesive 280 provides holding power.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A one-piece, protective anti-scatter grid structure for protectively housing an X-ray cassette therein, the grid structure comprising:

(a) a flat top panel forming a base for the grid structure;

(b) the flat top panel having a size adapted to support the X-ray cassette;

(c) the flat top panel having a first side, a second side, a third side, and a fourth side;

(d) the first side including a first U-shaped member;

(e) the second side including a second U-shaped member;

(f) the third side including a third U-shaped member;

(g) the one-piece, protective anti-scatter grid structure having at least one open corner; and (h) the first U-shaped member, the second U-shaped member, and the third-shaped member cooperating with the flat panel in order to provide a support for an X-ray cassette.

2. The one-piece, protective anti-scatter grid structure of claim 1 further comprising:

(a) the first U-shaped member being formed with a first elongated member and a first bottom edge in combination with the top panel;

(b) the second U-shaped member being formed with a second elongated member and a second bottom edge in combination with the top panel; and (c) the third U-shaped member being formed with a third elongated member and a third bottom edge in combination with the top panel.

3. The one-piece, protective anti-scatter grid structure of claim 2 further comprising:

(a) a first open corner being between the first U-shaped member and the second U-shaped member; and (b) a second open corner being between the second U-shaped member and the third U-shaped member.

4. The one-piece, protective anti-scatter grid structure of claim 3 further comprising:

(a) a third open corner being oppositely disposed from the first open corner; and (b) a fourth open corner being oppositely disposed from the second open corner.

5. The one-piece, protective anti-scatter grid structure of claim 4 further comprising the grid structure being formed of bendable aluminum.

6. The one-piece, protective anti-scatter grid structure of claim 4 further comprising:

(a) a vinyl cover being secured to the top panel;

(b) the vinyl cover having a securing means on the top panel; and (c) the securing means being at least one means selected from the group consisting of bonding, gluing, and molding the grid structure being formed of bendable aluminum.

7. The one-piece, protective anti-scatter grid structure of claim 1 further comprising:

(a) a vinyl cover being secured to the top panel;

(b) the vinyl cover having a securing means on the top panel; and (c) the securing means being at least one means selected from the group consisting of bonding, gluing, and molding the grid structure being formed of bendable aluminum.

8. The one-piece, protective anti-scatter grid structure of claim 7 further comprising:

(a) the first U-shaped member being formed with a first elongated member and a first bottom edge in combination with the top panel;

(b) the second U-shaped member being formed with a second elongated member and a second bottom edge in combination with the top panel; and (c) the third U-shaped member being formed with a third elongated member and a third bottom edge in combination with the top panel.

9. The one-piece, protective anti-scatter grid structure of claim 8 further comprising:

(a) a first open corner being between the first U-shaped member and the second U-shaped member;

(b) a second open corner being between the second U-shaped member and the third U-shaped member;

(c) a third open corner being oppositely disposed from the first open corner; and (d) a fourth open corner being oppositely disposed from the second open corner.

10. The one-piece, protective anti-scatter grid structure of claim 9 further comprising the grid structure being formed of bendable aluminum.

11. A two-piece, protective anti-scatter grid structure for protectively housing an X-ray cassette therein, the grid structure comprising:

(a) a top piece receiving a lower piece;

(b) the top piece being solid;

(c) the lower piece having a central opening; and (d) the grid structure being adapted to receive the X-ray cassette between the top piece and the lower piece.

12. The two-piece, protective anti-scatter grid structure of claim 11 further comprising:

(a) the two-piece, protective anti-scatter grid structure having open corners;

(b) the open corners providing for protection of the X-ray cassette and ease of assembly of the anti-scatter grid structure.

13. The two-piece, protective anti-scatter grid structure of claim 12 further comprising:

(a) the top piece having four edges;

(b) the top piece having four flanges, one flange at each of the four edges; and (c) each member of the four flanges being separate one from the other in order to provide the open corners.

14. The two-piece, protective anti-scatter grid structure of claim 13 further comprising:

(a) the lower piece having four borders;

(b) the lower piece having four flaps, one flap at each of the four borders; and (c) each of the four flaps corresponding to one of the four flanges in an assembled mode.

15. The two-piece, protective anti-scatter grid structure of claim 14 further comprising the grid structure being formed of bendable aluminum.

16. The two-piece, protective anti-scatter grid structure of claim 14 further comprising:

(a) a vinyl cover being secured to the top piece;

(b) the vinyl cover having a securing means on the top panel; and (c) the securing means being at least one means selected from the group consisting of bonding, gluing, and molding the grid structure being formed of bendable aluminum.

17. The two-piece, protective anti-scatter grid structure of claim 11 further comprising:

(a) a vinyl cover being secured to the top piece;

(b) the vinyl cover having a securing means on the top panel; and (c) the securing means being at least one means selected from the group consisting of bonding, gluing, and molding the grid structure being formed of bendable aluminum.

18. The two-piece, protective anti-scatter grid structure of claim 17 further comprising:

(a) the two-piece, protective anti-scatter grid structure having open corners;

(b) the open corners providing for protection of the X-ray cassette and ease of assembly of the anti-scatter grid structure.

19. The two-piece, protective anti-scatter grid structure of claim 18 further comprising:

(a) the top piece having four edges;

(b) the top piece having four flanges, one flange at each of the four edges; and (c) each member of the four flanges being separate one from the other in order to provide the open corners.

20. The two-piece, protective anti-scatter grid structure of claim 19 further comprising:

(a) the lower piece having four borders;

(b) the lower piece having four flaps, one flap at each of the four borders; and (c) each of the four flaps corresponding to one of the four flanges in an assembled mode.

21. The two-piece, protective anti-scatter grid structure of claim 20 further comprising the grid structure being formed of bendable aluminum.

* * * * *